US009797571B2

(12) United States Patent
Adams et al.

(10) Patent No.: US 9,797,571 B2
(45) Date of Patent: Oct. 24, 2017

(54) METHOD AND APPARATUS FOR A LIGHT COLLECTION AND PROJECTION SYSTEM

(71) Applicants: Stephen P. Adams, Mesa, AZ (US); Ronald G. Holder, Laguna Niguel, CA (US)

(72) Inventors: Stephen P. Adams, Mesa, AZ (US); Ronald G. Holder, Laguna Niguel, CA (US)

(73) Assignee: JST Performance, LLC, Gilbert, AZ (US)

( * ) Notice: Subject to any disclaimer, the term of this patent is extended or adjusted under 35 U.S.C. 154(b) by 0 days.

(21) Appl. No.: 14/448,050

(22) Filed: Jul. 31, 2014

(65) Prior Publication Data

US 2015/0036354 A1 Feb. 5, 2015

Related U.S. Application Data

(60) Provisional application No. 61/861,926, filed on Aug. 2, 2013.

(51) Int. Cl.
*F21V 3/00* (2015.01)
*F21V 5/00* (2015.01)
(Continued)

(52) U.S. Cl.
CPC ..... *F21V 5/007* (2013.01); *F21K 9/62* (2016.08); *F21V 7/0083* (2013.01); *F21V 13/04* (2013.01)

(58) Field of Classification Search
CPC ..... F21V 5/007; F21V 7/0083; F21V 7/041; F21V 7/048; F21V 13/04; F21V 17/002;
(Continued)

(56) References Cited

U.S. PATENT DOCUMENTS 4,254,453 A * 3/1981 Mouyard ..... G09F 13/22 340/815.54
4,733,335 A * 3/1988 Serizawa ..... B60Q 1/302 362/373
(Continued)

FOREIGN PATENT DOCUMENTS

DE WO 2013037556 A1 * 3/2013 ..... H01L 33/58

OTHER PUBLICATIONS

International Search Report and Written Opinion of the International Searching Authority for copending International Patent Application No. PCT/US14/49491, dated Nov. 13, 2014, 8 pages.

*Primary Examiner* — Alexander Garlen

(57) ABSTRACT

A method and apparatus for collecting and projecting light into a specified target illuminance. A lens may be mounted or otherwise paired to a carrier to form a lens/carrier combination, which may then be mounted to a printed circuit board containing a light emitting diode (LED). The lens/carrier combination may establish an optimum optical relationship between the LED and the lens, such that a predetermined photometric distribution of the LED is collected by the lens, while the remaining photometric distribution of the LED is rejected by the carrier. The photometric distribution of neighboring LEDs, if any, may also be rejected by the carrier so that interference light may not be allowed into any lens. A diffuser may then spread the specified target illuminance into a beam pattern that may be compliant with specific standards (e.g., Department of Transportation or Economic Commission for Europe standards).

13 Claims, 7 Drawing Sheets

(51) Int. Cl.
*F21V 7/00* (2006.01)
*F21K 9/62* (2016.01)
*F21V 13/04* (2006.01)

(58) Field of Classification Search
CPC ..... F21V 17/104; F21S 4/003; F21S 4/008; F21L 4/027; F21K 9/50; F21K 9/52; F21K 9/54; F21K 9/58
See application file for complete search history.

(56) References Cited

U.S. PATENT DOCUMENTS

| | | | | |
|---|---|---|---|---|
| 5,416,678 | A * | 5/1995 | Schabowski | F21S 4/003 362/238 |
| 6,036,338 | A * | 3/2000 | Gordin | F21V 7/09 362/297 |
| 6,283,613 | B1 * | 9/2001 | Schaffer | F21V 7/0083 116/63 R |
| 7,914,162 | B1 * | 3/2011 | Huang | B60L 1/14 219/220 |
| 8,174,740 | B2 | 5/2012 | Baxter et al. | |
| 2006/0268548 | A1 * | 11/2006 | Chang | F21V 13/04 362/245 |
| 2008/0084694 | A1 | 4/2008 | Rose et al. | |
| 2010/0195330 | A1 * | 8/2010 | Schaefer | F21S 8/085 362/237 |
| 2011/0249434 | A1 * | 10/2011 | McQuistian | F21V 7/0083 362/235 |
| 2012/0147589 | A1 * | 6/2012 | Farmer | F21V 7/0083 362/84 |
| 2013/0093325 | A1 | 4/2013 | Scarpelli | |
| 2013/0229796 | A1 * | 9/2013 | Tseng | F21S 4/003 362/225 |

* cited by examiner

METHOD AND APPARATUS FOR A LIGHT COLLECTION AND PROJECTION SYSTEM

FIELD OF THE INVENTION

The present invention generally relates to lighting systems, and more particularly to light collection and projection systems.

BACKGROUND

Light emitting diodes (LEDs) have been utilized since about the 1960s. However, for the first few decades of use, the relatively low light output and narrow range of colored illumination limited the LED utilization role to specialized applications (e.g., indicator lamps). As light output improved, LED utilization within other lighting systems, such as within LED "EXIT" signs and LED traffic signals, began to increase. Over the last several years, the white light output capacity of LEDs has more than tripled, thereby allowing the LED to become the lighting solution of choice for a wide range of lighting solutions.

LEDs exhibit significantly optimized characteristics for use in lighting fixtures, such as source efficacy, optical control and extremely long operating life, which make them excellent choices for general lighting applications. LED efficiencies, for example, may provide light output magnitudes that may exceed 100 lumens per watt of power dissipation. Energy savings may, therefore, be realized when utilizing LED-based lighting systems as compared to the energy usage of, for example, incandescent, halogen, compact fluorescent and mercury lamp lighting systems. As per an example, an LED-based lighting fixture may utilize a small percentage (e.g., 10-15%) of the power utilized by an incandescent bulb, but may still produce an equivalent magnitude of light.

LEDs may be mounted to a printed circuit board (PCB), which may include conductive regions (e.g., conductive pads) and associated control circuitry. The LED control terminals (e.g., the anode and cathode terminals of the LEDs) may be interconnected via the conductive pads, such that power supply and bias control signals may be applied to transition the LEDs between conductive and non-conductive states, thereby illuminating the LEDs on command.

The photometric distribution of a forward-biased LED may produce an omnidirectional pattern of light (e.g., a 180 degree spread of light emanating in all directions from a surface of the PCB upon which the LED is mounted). In order to modify such an omnidirectional photometric distribution, a plastic dome (e.g., an injection molded acrylic plastic cover) may be placed over the LED. In so doing, for example, the plastic dome may modify the photometric distribution pattern from that of an omnidirectional pattern to one of a non-omnidirectional pattern (e.g., a 120 degree spread of light emanating from a surface of the PCB). A lens may be mounted forward of the LED to further control the photometric distribution of the LED.

A system of one or more LEDs and associated lenses may, for example, be implemented within an LED-based lighting system. Each LED of such a system, however, may exhibit a photometric distribution such that the light emitted by one LED may be projected into one or more lenses that may be associated with one or more adjacent LEDs. In such an instance, for example, one lens may receive the light generated by one or more adjacent LEDs (e.g., interference light), which may adversely affect the pattern of light projected by the LED-based lighting system.

Efforts continue, therefore, to develop a multiple LED lighting system that reduces adverse interference light.

SUMMARY

To overcome limitations in the prior art, and to overcome other limitations that will become apparent upon reading and understanding the present specification, various embodiments of the present invention disclose methods and apparatus for the collection and projection of light in an LED-based lighting system.

In accordance with one embodiment of the invention, an LED-based lighting system comprises a PCB having first and second LEDs, a carrier coupled to the PCB, a first lens coupled to the carrier to receive light from the first LED and a second lens coupled to the carrier to receive light from the second LED. The carrier prevents light from the first LED from entering the second lens and the carrier prevents light from the second LED from entering the first lens.

In accordance with another embodiment of the invention, an LED-based lighting system comprises a PCB having an LED, a carrier coupled to the PCB, where the carrier has an aperture in a geometric relationship with the LED. The LED-based lighting system further comprises a lens configured to project light received from the LED into a target illuminance, wherein modification of the geometric relationship changes the target illuminance.

BRIEF DESCRIPTION OF THE DRAWINGS

Various aspects and advantages of the invention will become apparent upon review of the following detailed description and upon reference to the drawings in which.

DETAILED DESCRIPTION

Figure 1:
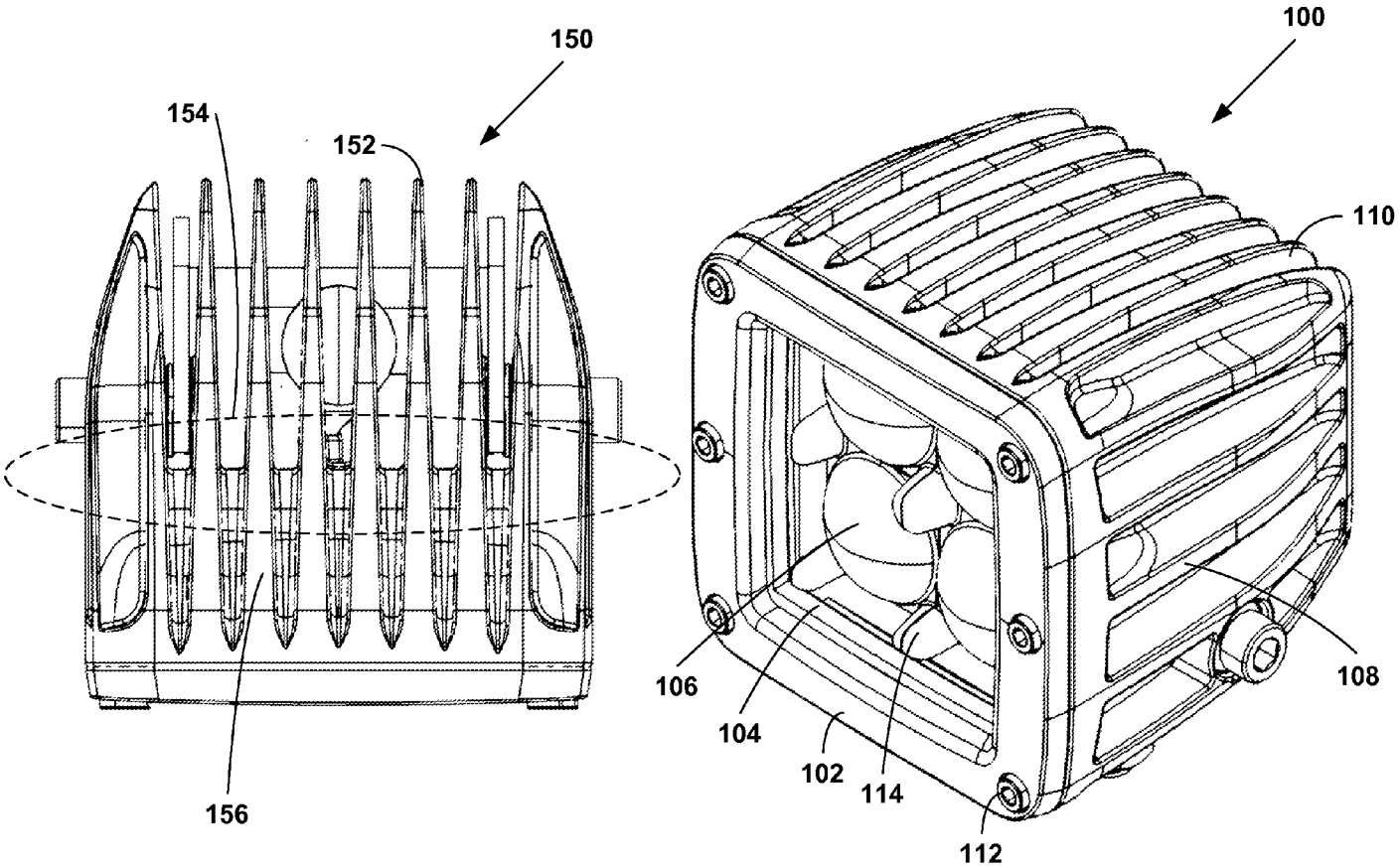
FIG. 1 illustrates an LED-based lighting fixture in accordance with one embodiment of the present invention.

Generally, the various embodiments of the present invention are applied to a light emitting diode (LED) based lighting system that may contain one or more LEDs and one or more associated lenses. The LEDs may be mounted to a PCB having control and bias circuitry that allows the LEDs to be illuminated on command. A lens may be mounted forward of an associated LED, so as to control a pattern of light that may be projected by each LED of the lighting system.

A carrier may be used to facilitate the mounting of the lens forward of its associated LED. For example, a carrier may exhibit a locking mechanism (e.g., a friction-based, male locking mechanism) that may be compatible with a corresponding locking mechanism (e.g., a friction-based, female locking mechanism) of the corresponding lens. Once interlocked (e.g., once the lens is "snapped" into place within the carrier), the lens may be secured within the carrier to form a carrier/lens combination, such that the position of the lens relative to the orientation of the carrier may create an optimal geometric relationship between the lens and the carrier. Alternately, for example, the carrier and lens may not necessarily include interlocking mechanisms.

The carrier may, for example, include one or more extrusions (e.g., legs) having indexing features (e.g., feet) that may allow the carrier/lens combination to be secured to a PCB at a particular orientation as defined by the indexing features. The PCB may, for example, include corresponding indexing features (e.g., holes) that may be configured to accept the indexing features of the carrier, such that once the carrier/lens combination engages the indexing features of the PCB, a position of the carrier/lens combination relative to the orientation of the PCB maintains an optimal geometric relationship between the LED mounted to the PCB and its corresponding carrier/lens combination.

The carrier/lens combination may couple a predetermined portion of the photometric distribution of its corresponding LED, such that the predetermined portion may be allowed to be projected into the corresponding carrier/lens combination, while the remaining portion of the photometric distribution may be disallowed from entering the corresponding carrier/lens combination. Furthermore, the remaining portion of the photometric distribution of an LED that may be disallowed from entering the corresponding carrier/lens combination, may also be prevented from entering the carrier/lens combinations associated with neighboring LEDs, if any, in the LED-based lighting system.

Each carrier of each carrier/lens combination may be configured with a bowl structure that is narrow at one end and wider at the other end. The narrow end of each carrier may be configured with an aperture such that once the carrier/lens combination engages the PCB, the aperture may be positioned over the corresponding LED to establish a geometric relationship between the LED and the aperture (e.g., an optimal separation distance between the aperture and the LED). Furthermore, the aperture may be beveled, or flanged, so as to present an aperture having an inner wall that is not perpendicular to an optical axis of its corresponding LED, but is rather angled with respect to an optical axis of its corresponding LED. Accordingly, for example, light emanating from the LED at an angle greater than the angle formed by the inside wall of the aperture may be projected onto its corresponding lens, while light emanating from the LED at an angle less than the angle formed by the inside wall of the aperture may be prohibited from projecting onto its corresponding lens.

The bowl structure of each carrier may be configured to reduce, or eliminate, reflections of light that may be incident onto the bowl structure. For example, the bowl structure may exhibit a surface that provides hard optical angles (e.g., a stair-stepped surface or a rounded stair-stepped surface) such that any light incident on the bowl structure may be reflected, if at all, away from the corresponding lens. In addition, the bowl structure may exhibit a non-reflective color (e.g., black) so as to be substantially non-reflective of any light that may be incident on the bowl structure. Further, the bowl structure may exhibit a non-reflective texture (e.g., a coarse texture) so as to be substantially non-reflective of any light that may be incident on the bowl structure.

An optical system that may include a PCB, LED, and a carrier/lens combination may combine to substantially project a portion of the light emitted from the LED onto its corresponding lens, while substantially rejecting all other light that may otherwise be incident on the corresponding lens (e.g., reflected light from the corresponding LED or incident light from neighboring LEDs). Accordingly, the light projected by the LED-based lighting system may exhibit a specified target illuminance (e.g., a spot beam pattern), while rejecting substantially all other light that might otherwise exist outside of the target illuminance (e.g., spill light outside of the spot beam pattern).

The lens of each carrier/lens combination may exhibit various configurations. For example, the lens may exhibit two convex surfaces (e.g., a biconvex configuration), or may exhibit a flat surface on one side of the lens and a convex surface on the other side of the lens (e.g., a plano-convex configuration). The lens may, for example, exhibit two convex surfaces, where the radius of curvature of one convex surface may be different than the radius of curvature of the other convex surface. The lens may, for example, exhibit two convex surfaces, where the radius of curvature of one convex surface may be the same as the radius of curvature of the other convex surface (e.g., a equi-convex configuration). The lens may, for example, exhibit an optical surface that may be broken up into narrow, concentric rings (e.g., a Fresnel lens configuration), such that the lens may be manufactured to be thinner and, therefore, lighter than the convex or plano-convex configurations.

Once the photometric distribution of an LED of an LED-based lighting system has been controlled into an initial target illuminance (e.g., a spot beam pattern), other optical treatments may be applied to effect a subsequent target illuminance that may be produced from the initial target illuminance. For example, a supplemental optic (e.g., a diffuser) may be used to spread the initial target illuminance into a wider beam pattern that may exhibit attributes that may be beneficial in certain applications. For example, a diffuser may be applied to spread the initial target illuminance into a pattern that may be compliant with standards as promulgated by the U.S. Department of Transportation or the Economic Commission for Europe. An additional diffuser may be applied, for example, whereby the initial target illuminance may be spread by a first diffuser and spread again by a second diffuser (e.g., a first diffuser may spread light along a horizontal axis and a second diffuser may spread the horizontally spread light along a vertical axis).

Turning to FIG. 1, an exemplary LED-based lighting fixture 100 is illustrated, which may include body portion 108 and heat sink portion 110. Body portion 108 may, for example, include one or more lenses 106, a plate (e.g., transparent plate 104), and bezel 102. LED-based lighting fixture 100 may further include one or more carriers (not shown) which may provide a retaining mechanism for lenses 106. LED-based lighting fixture 100 may further include a PCB (not shown) which may include one or more LEDs (not shown), associated LED bias and control circuitry (not shown) and mechanical indexing (not shown) to retain lenses 106 and associated carriers. Plate 104 may be held into place by bezel 102 and associated bezel hardware 112. In addition, plate 104 may be in mechanical communication with extensions 114, such that once bezel 102 is held in place by bezel hardware 112, transparent plate 104 may contact extensions 114 to press lenses 106 and their associated carriers into the corresponding mechanical indexing of the PCB. Accordingly, for example, the optical system within body portion 108 may be held in place via plate 104, bezel 102 and bezel hardware 112 so as to preserve the optimal geometric relationship between the LEDs and associated lenses 106. Alternately, for example, the optical system within body portion 108 may be held in place by other mechanical means (e.g., screws).

A side view of LED-based lighting fixture 150 is illustrated, which exemplifies heat sink fins 152 and their connection to body portion 156. Accordingly, for example, heat sink fins 152 may be in thermal communication with body portion 156 along interface 154, such that heat generated within body portion 156 may be transferred to heat sink fins 152 along interface 154, thereby reducing the temperature of body portion 156 and the electronic components (e.g., LEDs) mounted therein. For example, body portion 156 may contain a PCB (not shown) with LEDs mounted thereon (not shown) that may be in thermal communication with heat sink fins 152 via body portion 156 along interface 154. As the LEDs are illuminated, power may be dissipated by the LEDs into heat, which may then be transferred to heat sink fins 152. Heat sink fins 152 may then conduct the heat into the atmosphere that surrounds heat sink fins 152 thereby reducing the temperature of body portion 156 and reducing the temperature of the LEDs mounted therein.

It should be noted that virtually any light fixture may accommodate an LED-based lighting system having one or more LEDs. For example, single-LED light fixtures, single-row light bars, double-row lights bars, and matrix light fixtures, to name only a few, may accommodate the light collection and projection systems provided herein.

Figure 2:
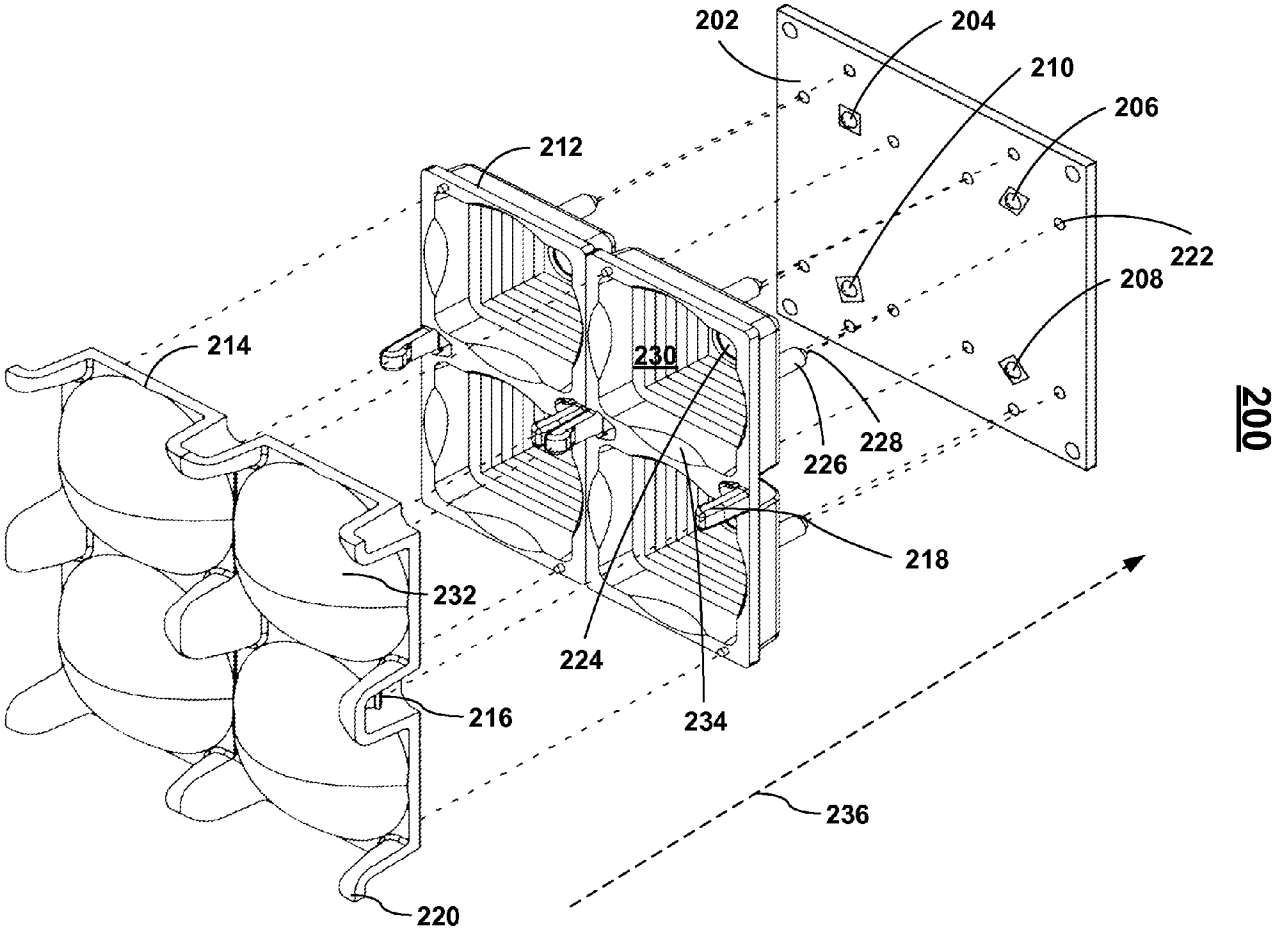
FIG. 2 illustrates a light collection and projection system in accordance with one embodiment of the present invention.

Turning to FIG. 2, an exploded view of light collection and projection system 200 is exemplified, which may include PCB 202 with one or more LEDs (e.g., LEDs 204-210) and associated bias and control circuitry (not shown) mounted thereon. Light collection and projection system 200 may further include carrier 212 that may include one or more bowl structures 230 and a lens structure 214 that may include one or more lenses 232. PCB 202 may, for example, include mechanical indexing features (e.g., holes 222) that may be associated with corresponding mechanical indexing features (e.g., feet 228) of extension portions (e.g., legs 226) of carrier 212. Once engaged, the mechanical indexing features (e.g., holes 222 and feet 228) of PCB 202 and carrier 212, respectively, may create an optimized geometric relationship between LEDs 204-210 and the corresponding apertures 224 of carrier 212.

Such an optimized geometric relationship may, for example, include an optimized separation distance (e.g., between approximately 0.03 and 0.04 inches) between a bottom portion of carrier 212 and a top portion of LEDs 204-210 as may be facilitated by extension portions (e.g., legs 226) of carrier 212. Such an optimized separation distance may, for example, facilitate a predetermined portion of the photometric distribution of LEDs 204-210 to be collected by the corresponding apertures 224 of carrier 212. In addition, such an optimized separation distance may, for example, facilitate a predetermined portion of the photometric distribution of LEDs 204-210 to be prohibited from being collected by the corresponding apertures 224 of carrier 212.

Carrier 212 may, for example, include bowl portion 230, which may include a narrow end (e.g., the end of bowl portion 230 that includes aperture 224) and a wide end (e.g., the end of bowl portion 230 that is opposite the narrow end of aperture 224). Bowl portion 230 may include surfaces (e.g., the four inner walls of bowl portion 230) that may exhibit hard optical angles (e.g., a stair-stepped surface) such that any light that may be incident on the four inner walls of bowl structure 230 may be reflected, if at all, away from corresponding lens 232.

It should be noted that manufacturing techniques may somewhat preclude the formation of hard optical angles. In such an instance, for example, the corners of the stair-stepped structure of the inner walls of bowl portion 230 may exhibit a nominal radius of curvature (e.g., 1/32 of an inch). In other words, the corners of the stair-stepped structure of the inner walls of bowl portion 230 may be somewhat rounded.

In addition, bowl structure 230 may exhibit a non-reflective color (e.g., black) so as to be substantially non-reflective of any light that may be incident on the bowl structure 230. Further, bowl structure 230 may exhibit a non-reflective texture (e.g., a coarse texture) so as to be substantially non-reflective of any light that may be incident on the bowl structure 230.

Bowl structure 230 may include one or more concave recesses 234 that may exist at the wide end of bowl structure 230. Concave recesses 234 may, for example, be configured to receive respective bottom portions of lens 232 after carrier 212 and lens structure 214 are mated to one another to form a carrier/lens assembly. Lens 232 may, for example, exhibit a bi-convex configuration, such that the radius of curvature of a bottom portion of lens 232 matches the radius of curvature of concave recesses 234.

Carrier 212 may include one or more locking mechanisms (e.g., friction-based male locking mechanisms 218) and lens structure 214 may include one or more corresponding locking mechanisms (e.g., friction-based female locking mechanisms 216). Accordingly, for example, once carrier 212 and lens structure 214 are mated to one another to form a carrier/lens assembly, friction-based male locking mechanisms 218 and corresponding friction-based female locking mechanisms 216 may engage each other to lock (e.g., temporarily lock) the carrier/lens assembly in place.

Lens structure 214 may include one or more extensions 220. Extensions 220 may, for example, engage portions of an LED-based lighting fixture (a transparent plate of the LED-based lighting fixture not shown), thereby imposing a pressure on extensions 220 along axis 236 to press carrier 212 and lens structure 214 against PCB 202. Accordingly, for example, light collection and projection system 200 may maintain optimized geometric relationships while being operational within the LED-based lighting fixture.

It should be noted that lens structure 214 may not necessarily be a bi-convex structure as shown. Instead, for example, lens structure 214 may include a Fresnel lens, which may exhibit an optical surface that may be broken up into narrow, concentric rings. Other alternatives that may be used as lens structure 214 may include plano-convex configurations and equi-convex configurations to name only a few.

Figure 3:
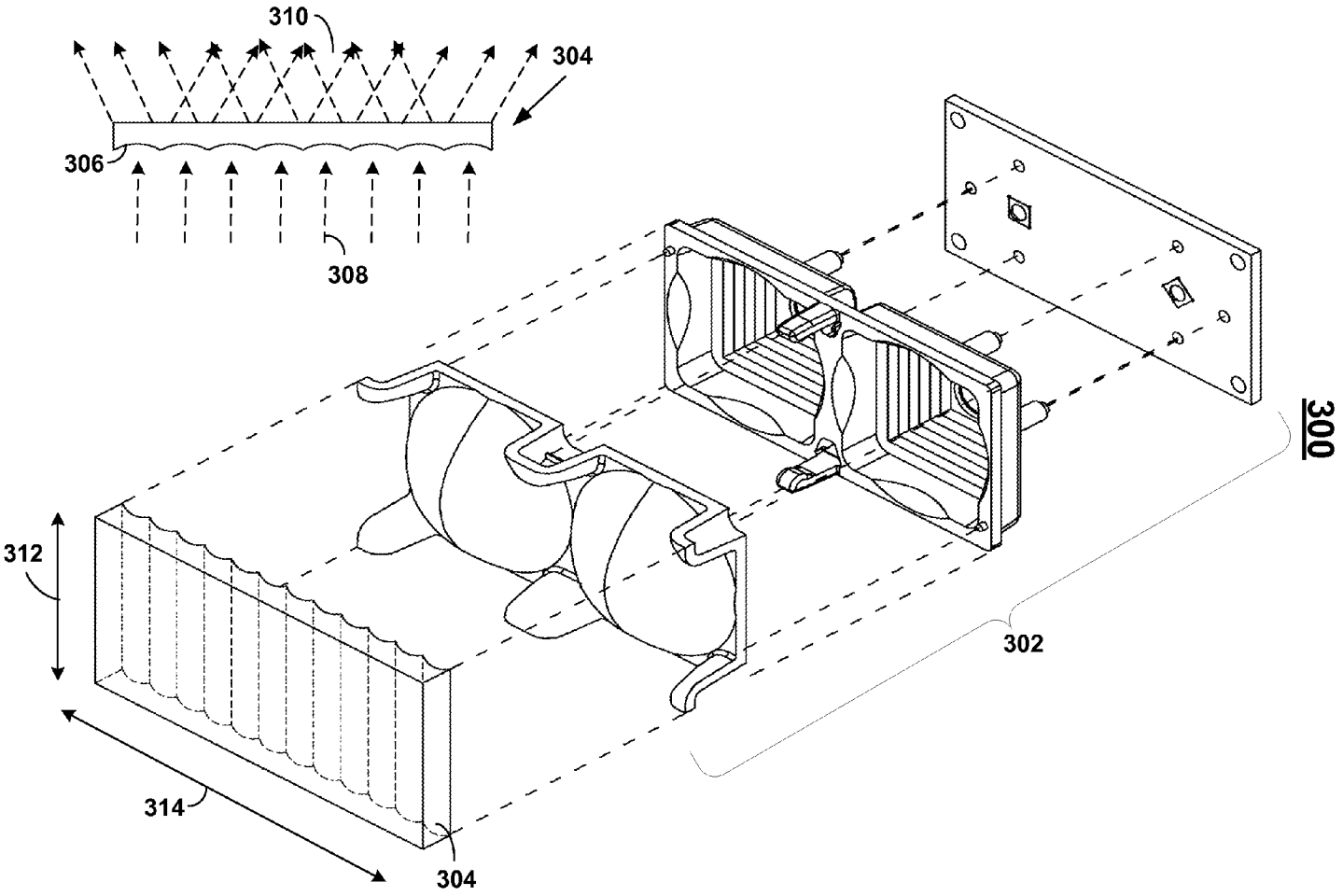
FIG. 3 illustrates an alternate light collection and projection system in accordance with one embodiment of the present invention.

Turning to FIG. 3, an exploded view of light collection and projection system 300 is exemplified, which may include a collection and projection system (e.g., two-LED collection and projection system 302) and diffuser 304. Diffuser 304 may, for example, also function as a plate of an LED-based lighting fixture (e.g., transparent plate 104 of FIG. 1). Conversely, the LED-based lighting fixture may include a separate plate (not shown), whereby diffuser 304 may be temporarily or permanently attached to the plate.

As an example, diffuser 304 may exhibit scalloped structure 306, where each scallop may exhibit an arc (e.g., a 45 degree arc) that may run the entire width 312 of diffuser 304.

In operation, diffuser 304 may receive a controlled beam of light having a specified target illuminance (e.g., spot beam 308) as may be projected by LED-based lighting system 302. Diffuser 304 may, for example, spread the light projected by spot beam 308 into diffused beam 310, whereby spot beam 308 may be transformed into a secondary target illuminance that may conform to standards as promulgated, for example, by the Department of Transportation or the Economic Commission for Europe. In such an instance, for example, diffused beam 310 may be compatible for use as a head light in automotive applications.

An additional diffuser (not shown) may be superimposed upon diffuser 304 to diffuse light along a different axis than light diffused by diffuser 304. For example, the additional diffuser may exhibit a scalloped structure, where each scallop may exhibit an arc that may run the entire length 314 of the additional diffuser. In operation, the additional diffuser may receive a controlled beam of light having a specified target illuminance (e.g., diffused beam 310). The additional diffuser may, for example, spread diffused beam 310 into a different diffused beam, whereby diffused beam 310 may be transformed into a tertiary target illuminance (e.g., multiple directions of light at differing intensities).

It should be noted that any types and/or combinations of diffusers may be utilized with light collection and projection system 302. Bulk/die additive diffusers may be utilized, for example, whereby inks, dies or other light-absorbing chemicals may be added to the diffuser substrate to create a combination of intensity, reflection, refraction and/or diffraction. Holographic diffusers may, for example, include surface structures of various shapes to diffract light in accordance with a particular application. Volumetric diffusers may, for example, be utilized that suspend particles within the diffuser substrate to guide light through refraction in a controlled fashion.

For example, two 20-degree diffusers superimposed on each other and aligned along the same axis may provide the same target illuminance of a single 45-degree diffuser. As per another example, two diffusers superimposed on each other and aligned along orthogonal axes may combine to form a symmetrical flood beam when diffusing a collected light source (e.g., spot beam 308).

Figure 4:
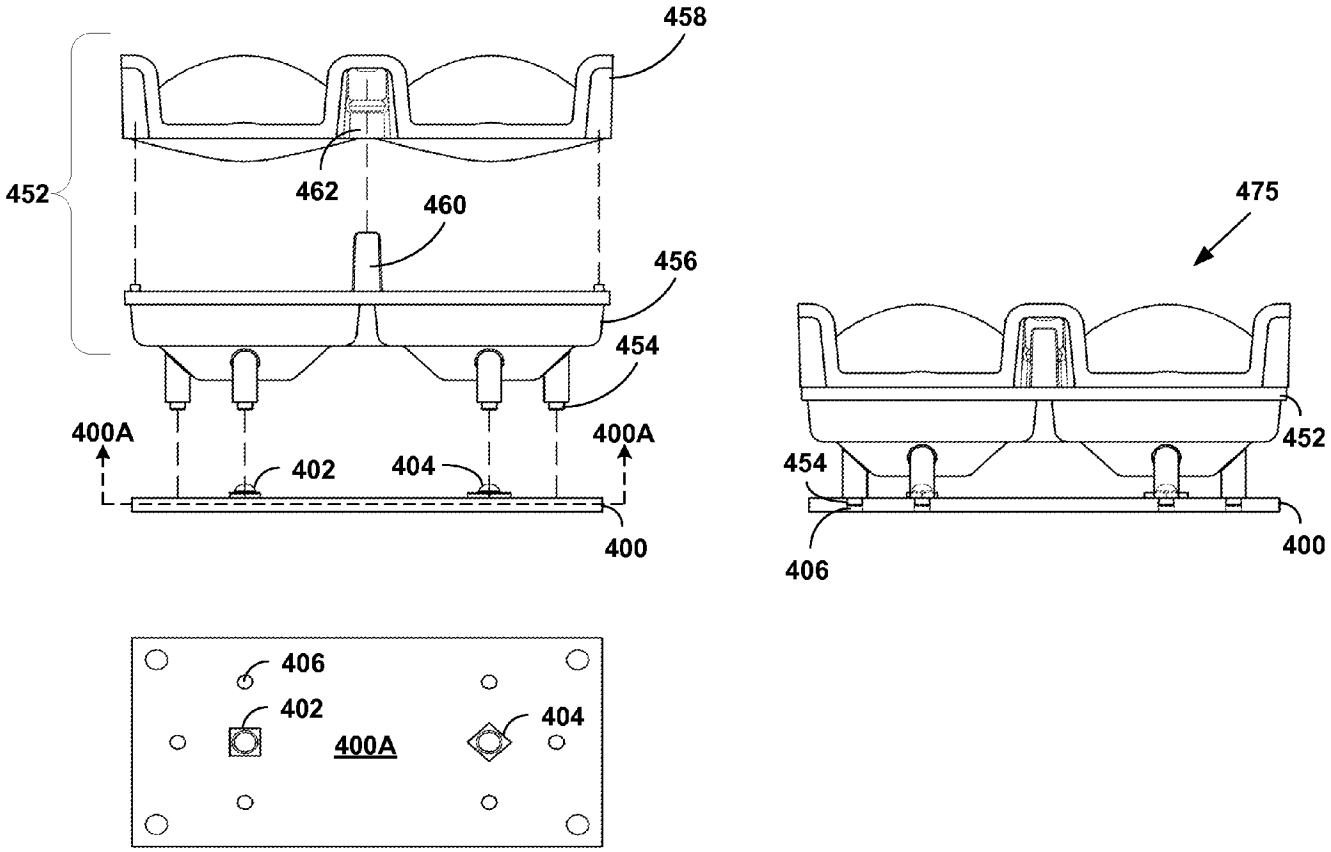
FIG. 4 illustrates side and plan views of a light collection and projection system in accordance with one embodiment of the present invention.

Turning to FIG. 4, various plan and side views of a light collection and projection system are exemplified. PCB 400, for example, is illustrated in plan view 400A to exemplify placement of LEDs 402 and 404 relative to one another. LED 402, for example, may exhibit an orientation as shown and LED 404 may exhibit an orientation that is rotated with respect to LED 402. As per an example, LED 404 may be rotated (e.g., rotated by 45 degrees) with respect to the orientation of LED 402.

Light collection and projection systems exhibiting a number of LEDs greater than two may exhibit similar LED orientations that may be dependent upon the specific number of LEDs being utilized. For example, a light collection and projection system utilizing three LEDs, may rotate the placement of each LED by 30 degrees with respect to one another. As per another example, a light collection and projection system utilizing four LEDs, may rotate the placement of each LED by 22.5 degrees with respect to one another. In general, the specific rotation exhibited by each LED may be calculated by equation (1) as:

$$R=90/N, \quad (1)$$

where N is the number of LEDs utilized in a light collection and projection system and R is the rotation offset in degrees that may by exhibited by each LED. Accordingly, for example, a light collection and projection system utilizing six LEDs may exhibit LEDs that are rotated by 15 degrees with respect to one another.

PCB 400 may, for example, utilize mechanical indexing features (e.g., holes 406) that may be configured to accept the mechanical indexing features (e.g., feet 454) of a component (e.g., carrier 456) to engage carrier 456 to PCB 400. Carrier 456 may further be engaged to lens 458 to form a carrier/lens combination, whereby a locking mechanism (e.g., friction-based, male locking mechanism 460) may engage a corresponding locking mechanism (e.g., friction-based, female locking mechanism 462) to form carrier/lens combination 452.

Light collection and projection system 475 may include PCB 400 and carrier/lens combination 452. As illustrated, one or more mechanical indexing features 406 may engage corresponding mechanical indexing features 454 of carrier/lens combination 452 to form light collection and projection system 475. Light collection and projection system 475 may then be integrated within an LED-based lighting fixture (e.g., LED-based lighting fixture 100 of FIG. 1).

Figure 5:
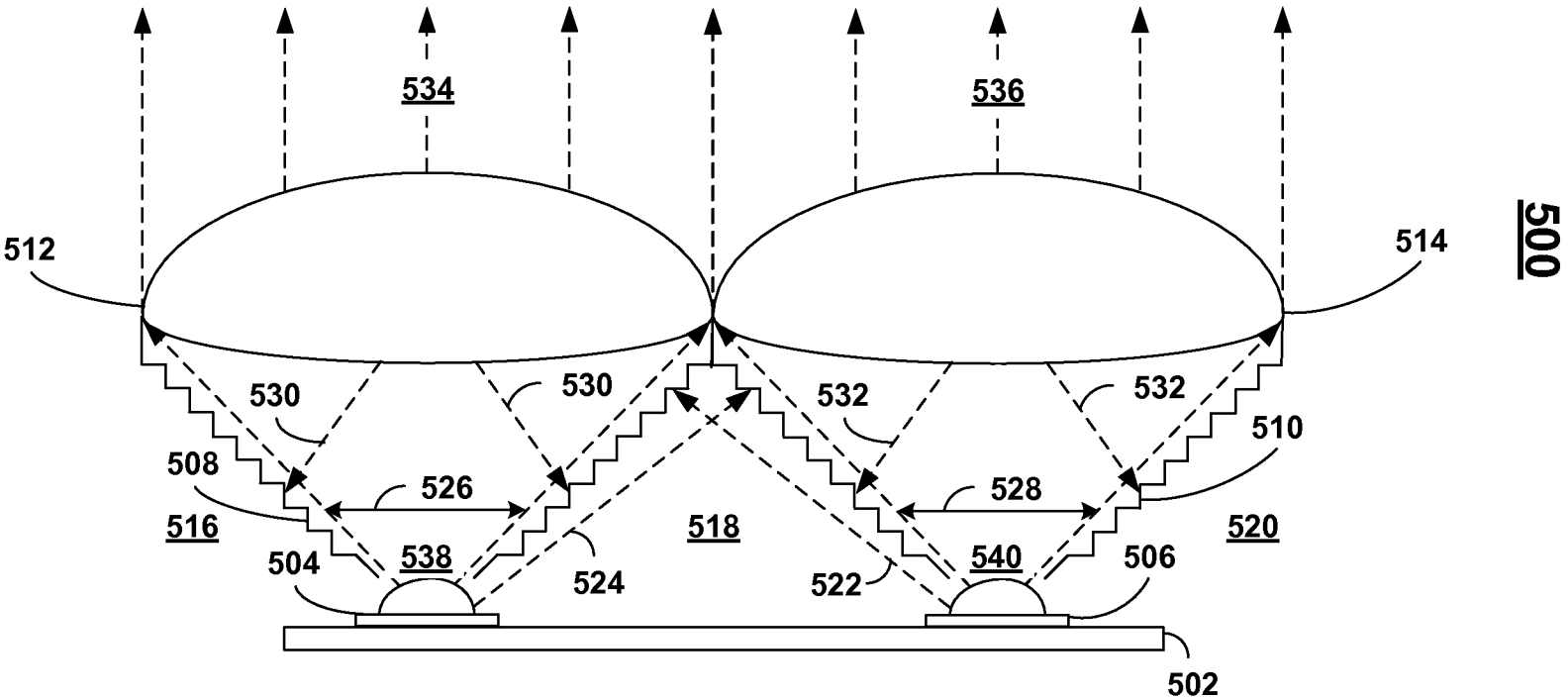
FIG. 5 illustrates a photometric diagram of a side view of a light collection and projection system in accordance with one embodiment of the present invention.

Turning to FIG. 5, a photometric diagram of a side view of a light collection and projection system is exemplified. Multiple LEDs (e.g., LEDs 504 and 506) may, for example, be mounted to PCB 502 along with bias and control circuitry (not shown) to illuminate LEDs 504 and 506 on command. The photometric distribution of LEDs 504 and 506 may, however, be such that light emitted from LED 504 may be received by lens 514 (e.g., interference light 524) and conversely, light emitted from LED 506 may be received by lens 512 (e.g., interference light 522). Accordingly, carrier 508 may be employed to block interference light 522 from entering lens 512 and carrier 510 may be employed to block interference light 524 from entering lens 514. Carrier 508 may further be employed to mechanically engage lens 512 to maintain an optimal geometric relationship between lens 512 and LED 504 and carrier 510 may further be employed to mechanically engage lens 514 to maintain an optimal geometric relationship between lens 514 and LED 506.

Carrier 508 may, for example, exhibit aperture 538 having a flanged, or angled, portion to allow light emanated from LED 504 (e.g., light having spread 526) to be passed on to lens 512. As can be seen, photometric distribution from LED 504 that extends outside of carrier 508 does not pass to lens 512, nor does it pass to lens 514 due to the blocking operation of carrier 510. Similarly, carrier 510 may, for example, exhibit aperture 540 having a flanged, or angled, portion to allow light emanated from LED 506 (e.g., light having spread 528) to be passed on to lens 514. As can be seen, photometric distribution from LED 506 that extends outside of carrier 510 does not pass to lens 514, nor does it pass to lens 512 due to the blocking operation of carrier 508.

Carrier 508 may, for example, exhibit hard optical angles (e.g., a stair-stepped surface having sharp corners or a stair-stepped surface having rounded corners) such that any light incident on the stair-stepped surface (e.g., light 530) may be reflected, if at all, away from lens 512. In addition, carrier 508 may exhibit a non-reflective color (e.g., black) so as to further increase absorption of light 530. Further, carrier 508 may exhibit a non-reflective texture (e.g., a coarse texture) so as to further increase absorption of light 530. Similarly, carrier 510 may, for example, exhibit hard optical angles (e.g., a stair-stepped surface having sharp corners or a stair-stepped surface having rounded corners) such that any light incident on the stair-stepped surface (e.g., light 532) may be reflected, if at all, away from lens 514. In addition, carrier 510 may exhibit a non-reflective color (e.g., black) so as to further increase absorption of light 532. Further, carrier 510 may exhibit a non-reflective texture (e.g., a coarse texture) so as to further increase absorption of light 532.

Light emanated from lens 512 (e.g., light 534) may, therefore, result from only that light emitted by LED 504 that falls within the photometric distribution as defined by aperture 538 of carrier 508. In addition, any light emitted by LED 506 is not permitted to enter lens 512 by virtue of carrier 508. Similarly, light emanated from lens 514 (e.g., light 536) may, therefore, result from only that light emitted by LED 506 that falls within the photometric distribution as defined by aperture 540 of carrier 510. In addition, any light emitted by LED 504 is not permitted to enter lens 514 by virtue of carrier 510.

Accordingly, for example, light emitted by each lens of an LED-based lighting system may be based almost entirely on the light emitted by the LED that is associated with that particular lens due to the shape, color, texture and other characteristics of the carrier that supports the lens. In so doing, a specified target illuminance (e.g., a spot beam pattern) may be provided by each lens of an LED-based lighting system that is substantially free from spill light or otherwise uncontrolled light.

Figure 6:
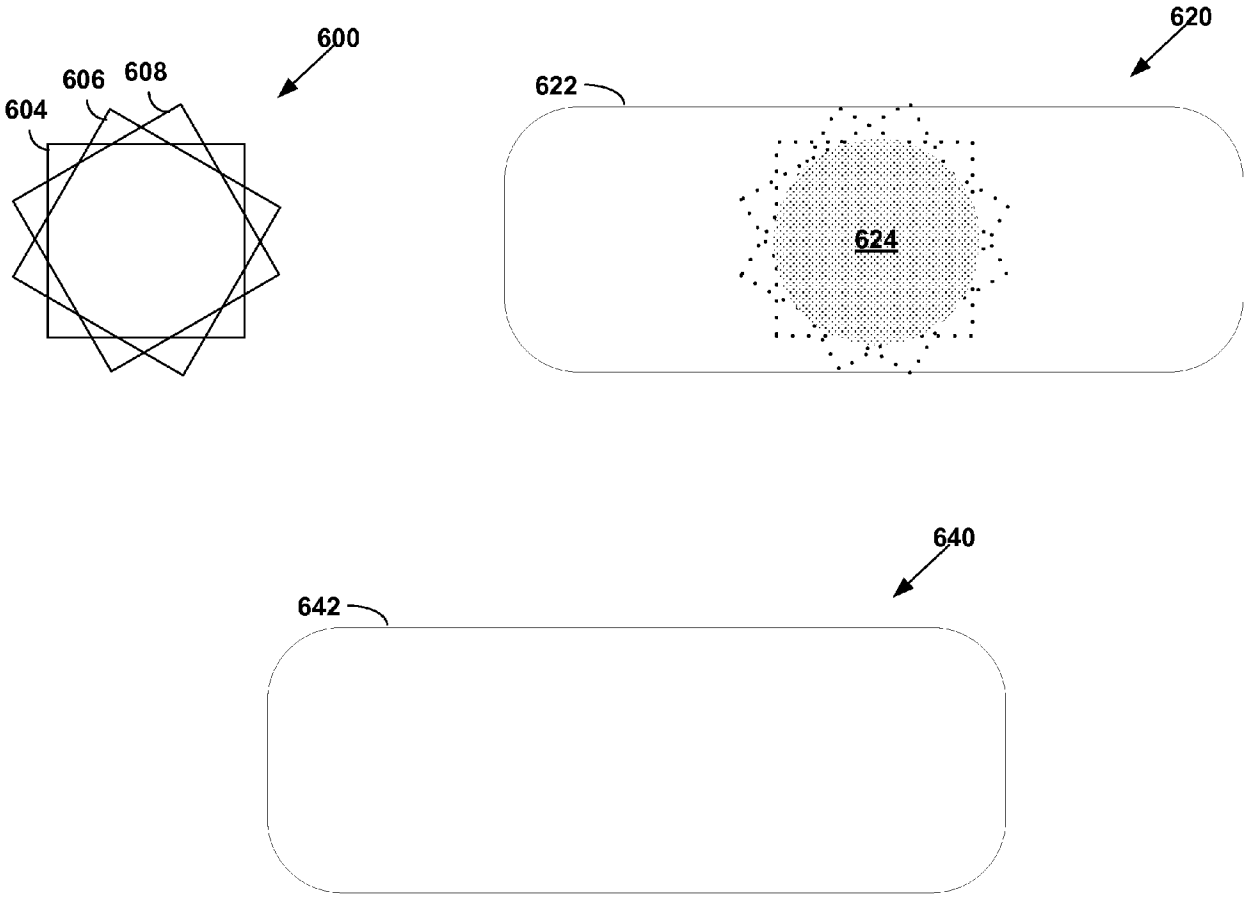
FIG. 6 illustrates light projection diagrams of various light collection and projection systems in accordance with various embodiments of the present invention.

Turning to FIG. 6, light projection diagrams are exemplified. Light projection diagram 600 may, for example, represent the specified target illuminance delivered by an LED-based lighting system having multiple (e.g., three) LEDs. A first beam pattern (e.g., beam pattern 604) may, for example, represent the specified target illuminance as provided by a first LED/carrier/lens combination. Second and third beam patterns (e.g., beam patterns 606 and 608) may, for example, represent the specified target illuminance delivered by second and third LEDs of an LED-based lighting system. As can be seen, each beam pattern may be rotated with respect to each of the other beam patterns by virtue of the rotation of each LED (e.g., as described in relation to FIG. 4) of the LED-based lighting system.

As per an example, beam patterns 604-608, as may be generated by a three-LED lighting system, may be rotated by 30 degrees with respect to each other as may be calculated from equation (1). In other words, for example, a substantially square beam pattern may be generated by each LED of an LED-based lighting system and the phase rotation of each beam pattern may be substantially equivalent to the phase rotation of each LED as mounted to its respective PCB. Accordingly, due to the rotation of beam patterns 604-608, any disturbances and/or imperfections that may exist within each of the beam patterns 604-608 individually may tend to be blended together (e.g., averaged).

Light projection diagram 620 may, for example, represent an alternate target illuminance that may be generated by first collecting the light into a specified target illuminance (e.g., spot beam patterns 604-608) and then partially diffusing the specified target illuminance into a broader beam pattern (e.g., beam pattern 622). Partial diffusion may result, for example, when the target illuminance from portions of one or more LED/carrier/lens combinations is diffused while the target illuminance from portions of the remaining LED/carrier/lens combinations is not diffused. Since spot beam patterns 604-608 are partially diffused, a concentration of light (e.g., concentration 624) may exist at a center portion of beam pattern 622, while the remaining light may be diffused across a broader beam pattern (e.g., beam pattern 622).

Light projection diagram 640 may, for example, represent an alternate target illuminance that may be generated by first collecting the light into a specified target illuminance (e.g., spot beam patterns 604-608) and then fully diffusing the specified target illuminance into a broader beam pattern (e.g., beam pattern 642). Full diffusion may result, for example, when the target illuminance from all LED/carrier/lens combinations is diffused (e.g., as illustrated in FIG. 3). Since spot beam patterns 604-608 are being fully diffused, a beam pattern substantially free from a concentration of light within the middle of the beam pattern (e.g., beam pattern 642) may result. Beam pattern 620 and 640 may, for example, be compliant with beam pattern standards as may be promulgated by the Department of Transportation or the Economic Commission for Europe.

Figure 7:
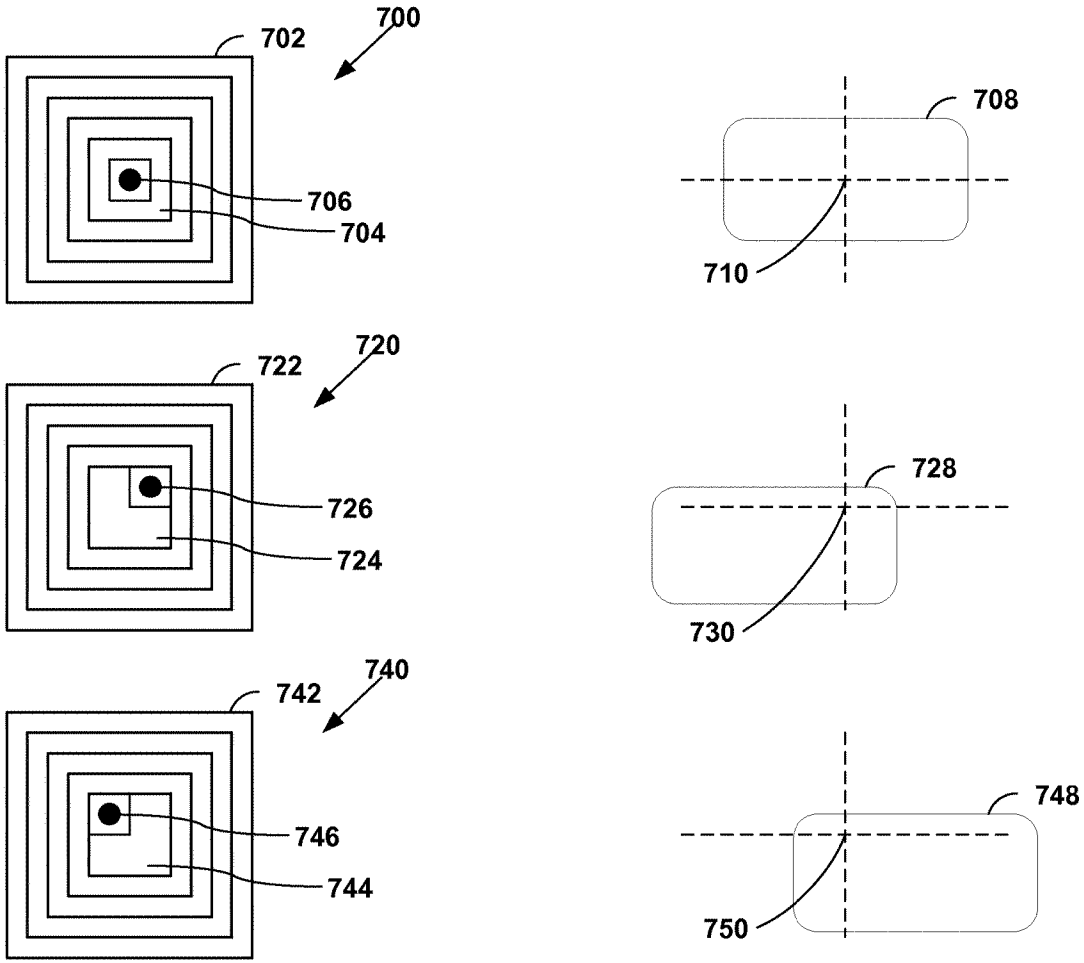
FIG. 7 illustrates geometric relationships between an LED and an associated carrier and resulting light projections in accordance with various embodiments of the present invention.

Turning to FIG. 7, illustrations 700, 720 and 740 exemplify variations in LED placement within the aperture of a carrier from a plan view perspective. Looking down into the bowl of carrier 702 of illustration 700, for example, it can be seen that LED 706 may be centered within aperture 704 as illustrated. The resulting target illuminance (e.g., as may be projected by LED 706, carrier 702, and an associated lens/diffuser combination) may be depicted by light projection 708, which may be substantially centered along an optical axis (e.g., optical axis 710 of LED 706) as shown.

Alternately, LED 726 may be offset within aperture 724 per illustration 720, where it can be seen that LED 726 may be offset to the upper right-hand corner within aperture 724 as illustrated. The resulting target illuminance (e.g., as may be projected by LED 726, carrier 722, and an associated lens/diffuser combination) may be depicted by light projection 728, which may be offset below and to the left of optical axis 730 as shown. In general, as LED 726 moves upward and toward the right relative to aperture 724, light projection 728 may be inverted and may, therefore, move downward and toward the left relative to optical axis 728.

Alternately, LED 746 may be offset within aperture 744 per illustration 740, where it can be seen that LED 746 may be offset to the upper left-hand corner within aperture 744 as illustrated. The resulting target illuminance (e.g., as may be projected by LED 746, carrier 742, and an associated lens/diffuser combination) may be depicted by light projection 748, which may be offset below and to the right of optical axis 750 as shown. In general, as LED 746 moves upward and toward the left relative to aperture 744, light projection 748 may be inverted and may, therefore, move downward and toward the right relative to optical axis 748.

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. An LED-based lighting system, comprising: a PCB having first and second LEDs; a carrier coupled to the PCB, the carrier including a first and a second aperture above each LED respectively, wherein the apertures are located at a bottom portion of the carrier and are disposed above top portions of the first and second LEDs respectively; a first lens coupled to a top side of the carrier to receive light passed through the first aperture from the first LED; and a second lens coupled to a top side of the carrier to receive light passed through the second aperture from the second LED, wherein the carrier prevents light from the first LED from entering the second lens, wherein the carrier prevents light from the second LED from entering the first lens, and wherein a portion of the light from the first and second LEDs is absorbed by a bottom side of the carrier.

2. The LED-based lighting system of claim 1, wherein the carrier includes a first locking mechanism configured to accept the first and second lenses.

3. The LED-based lighting system of claim 2, wherein the first and second lenses include a second locking mechanism configured to accept the first locking mechanism.

4. The LED-based lighting system of claim 1, wherein the carrier includes a bowl structure configured to reduce light reflections into the first and second lenses.

5. The LED-based lighting system of claim 1, wherein the carrier includes a texture configured to absorb light.

6. The LED-based lighting system of claim 1, wherein the carrier includes a color configured to absorb light.

7. The LED-based lighting system of claim 1, further including a diffuser, wherein the first and second lenses cast light into a primary target illuminance, and the diffuser transforms the light into a secondary target illuminance.

8. The LED-based lighting system of claim 1, wherein the first and second LEDs are rotated with respect to each other.

9. The LED-based lighting system of claim 1, wherein the first aperture is centered over the first LED and in response, the target illuminate is centered along an optical axis of the first LED.

10. The LED-based lighting system of claim 1, wherein the first aperture is not centered over the first LED and in response, the target illuminance is not centered along an optical axis of the first LED.

11. The LED-based lighting system of claim 1, wherein a separation distance between the bottom portion of the carrier and the top portions of the first and second LEDs is approximately 0.03 inches.

12. The LED-based lighting system of claim 1, wherein a separation distance between the bottom portion of the carrier and the top portions of the first and second LEDs is approximately 0.04 inches.

13. The LED-based lighting system of claim 1, wherein a separation distance between the bottom portion of the carrier and the top portions of the first and second LEDs is between approximately 0.03 inches and 0.04inches.

* * * * *